US011295710B1

(12) United States Patent
Hirasawa et al.

(10) Patent No.: US 11,295,710 B1
(45) Date of Patent: Apr. 5, 2022

(54) BASS DRUM PAD AND DRUM KIT

(71) Applicant: HOSHINO GAKKI CO., LTD., Aichi (JP)

(72) Inventors: Satoshi Hirasawa, Nagoya (JP); Atsushi Honjo, Nagoya (JP)

(73) Assignee: HOSHINO GAKKI CO., LTD., Aichi (JP)

( * ) Notice: Subject to any disclaimer, the term of this patent is extended or adjusted under 35 U.S.C. 154(b) by 0 days.

(21) Appl. No.: 17/177,134

(22) Filed: Feb. 16, 2021

(30) Foreign Application Priority Data

Oct. 28, 2020 (JP) ..... JP2020-180541

(51) Int. Cl.

| | |
|---|---|
| ***G10D 13/03*** | (2020.01) |
| ***G10D 13/14*** | (2020.01) |
| ***G10D 13/10*** | (2020.01) |
| ***G10D 13/11*** | (2020.01) |

(52) U.S. Cl.
CPC ..... *G10D 13/03* (2020.02); *G10D 13/11* (2020.02); *G10D 13/14* (2020.02); *G10D 13/28* (2020.02)

(58) Field of Classification Search
CPC ..... G10D 13/03; G10D 13/28; G10D 13/11; G10D 13/14
See application file for complete search history.

(56) References Cited

U.S. PATENT DOCUMENTS 3,264,926 A * 8/1966 Belli ..... G10D 13/03 84/411 R
7,348,479 B1 3/2008 Lombardi

* cited by examiner

*Primary Examiner* — Kimberly R Lockett

(57) ABSTRACT

A bass pad includes a frame body, a pad body, and a leg-opening mechanism. The frame body includes a pad base and a main post. The pad base is fixed to a clamp of a pedal device. The main post is arranged integrally with the pad base. The leg-opening mechanism includes two legs, two stays, and a sliding member. The height and angle of the pad base are adjusted by moving the sliding member in an axial direction of the main post to open or close the legs and the stays with respect to the main post.

12 Claims, 13 Drawing Sheets

BASS DRUM PAD AND DRUM KIT

BACKGROUND

1. Field

The following description relates to a bass drum pad and a drum kit.

2. Description of Related Art

A typical drum practice kit allows a user to practice drumming indoors. U.S. Pat. No. 7,348,479 discloses a drum practice kit that includes multiple types of practice pads and a tubular stand including three legs and a pipe. Disc-shaped practice pads having different diameters are attached to the upper part of the stand by rods and positioning members. The practice pads include a snare pad, a tom pad, a cymbal pad, and the like.

A substantially elliptic bass drum practice pad is attached to the central part of the stand by a positioning member. A coupling mechanism is connected to the lower end of the stand to couple the drum practice kit to a pedal device. The coupling mechanism includes a shaft and a plate that extends from the lower end of the shaft in a horizontal direction. The shaft is inserted into the pipe of the stand and fixed by a screw.

The pedal device includes a pedal base, a pedal, and a beater. The pedal is coupled to the pedal base. The beater is coupled to the free end of the pedal by a chain. A clamp is arranged at a central part on the front end of the pedal base to connect the drum practice kit and the pedal base. The plate of the coupling mechanism is fixed by the clamp so that the drum practice kit is connected to the pedal device. In this state, the drum practice kit is set on a floor surface and used together with the pedal device.

Multiple manufacturers provide various types of pedal devices. Further, an individual manufacturer may provide various types of pedal devices. Also, various types of clamps that differ in height and angle are employed in accordance with the type of the pedal device. Accordingly, there is a need for the drum practice kit to be able to be coupled to various types of pedal devices in accordance with the height and angle of the clamp.

In this respect, the drum practice kit disclosed in U.S. Pat. No. 7,348,479 allows the position of the plate to be adjusted in a vertical direction by loosening the screw and moving the shaft in the pipe in the vertical direction. In this manner, the drum practice kit can be coupled to the pedal device in accordance with the height of the clamp. However, the coupling mechanism is not configured to couple the drum practice kit to the pedal device in accordance with the angle of the clamp. Thus, if the clamp is angled, the legs of the stand and the bottom surface of the pedal base will not be located on the same plane in a state in which the drum practice kit is coupled to the pedal device. In this case, the drum practice kit may be unstable on the setting surface and adversely affect drumming practice.

In this respect, a bass drum practice pad 200 shown in FIG. 18 has been suggested. The bass drum practice pad 200 includes a pad base 201, main posts 202, and a pad body 203. The main posts 202 are fixed to the upper surface of the pad base 201. The pad body 203 is fixed to the upper ends of the main posts 202. A coupling member 204 is attached to the pad base 201 to couple the bass drum practice pad 200 to a pedal device 300.

As shown in FIG. 19, the coupling member 204 includes two fastening portions 204*a* and an extension portion 204*b*. The fastening portions 204*a* are fastened to two opposite sides of the pad base 201 by screws 205. The extension portion 204*b* extends between the fastening portions 204*a*. When the extension portion 204*b* of the coupling member 204 is fixed to a clamp 301, the bass drum practice pad 200 is coupled to the pedal device 300. In this state, the bass drum practice pad 200 is placed on a setting surface FL shown in FIG. 18 and used with the pedal device 300.

Each fastening portion 204*a* of the coupling member 204 includes an insertion hole 204*c* for insertion of the screw 205. The insertion hole 204*c* is vertically elongated. Further, the two opposite sides of the pad base 201 each include a screw hole (not shown) into which the screw 205 is inserted. With this structure, when the screws 205 are loosened, the coupling member 204 is movable relative to the pad base 201 in the vertical direction and pivotal about the axis of the screws 205. This allows the bass drum practice pad 200 to be coupled to the pedal device 300 in accordance with the angle of the clamp 301 and the height of the clamp 301.

However, with the bass drum practice pad 200 shown in FIGS. 18 and 19, when the pedal is depressed and the beater beats the pad body 203, angular momentum acts between the coupling member 204, which is arranged on the lower part of the bass drum practice pad 200, and the pad body 203, which is arranged on the upper part of the bass drum practice pad 200. In this case, the long distance between the coupling member 204 and the pad body 203 results in the region near to the coupling member 204 being easily affected by the angular momentum. Further, the coupling member 204 is connected to the pad base 201 by the screws 205. Thus, the force of the angular momentum acting on the coupling member 204 may change the coupling angle of the coupling member 204 and the pad base 201 from an adjusted angle and may displace the main posts 202 and the pad body 203 from adjusted positions. Accordingly, when the pedal is repetitively depressed, the force of the angular momentum intermittently acting on the coupling member 204 may further increase the change in the coupling angle of the coupling member 204 and the pad base 201 and further displace the main posts 202 and the pad body 203. In this manner, with the bass drum practice pad 200, the bass drum practice pad 200 may become unstable on the setting surface and adversely affect drumming practice.

SUMMARY

One object of the present disclosure is to provide a bass drum pad and a drum kit that improves stability when set to be coupled to a pedal device.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a bass drum pad used in a state coupled to a clamp of a pedal device is provided. The bass drum pad includes a pad base, a main post, a pad body, and a leg. The pad base is fixed to the clamp. The main post is arranged integrally with the pad base. The pad body is arranged on the main post and beaten by the pedal device. The leg is arranged on the main post or the pad body and used when setting the bass drum pad. The bass drum pad is configured so that a height and an angle of the pad base are adjustable. The height of the pad base is taken along an orthogonal line that is orthogonal to a setting surface on which the bass drum pad is set. The angle of the pad base is an angle of an axis of the main post relative to the orthogonal line.

In another general aspect, a drum kit is provided. The drum kit includes a bass drum pad, a percussion instrument pad, a stand, and a positioning member. The bass drum pad is beaten by a pedal device. The percussion instrument pad differs from the bass drum pad. The percussion instrument pad is attached to the stand. The bass drum pad is located between the stand and the pedal device. The positioning member is used to position the stand relative to the bass drum pad. The positioning member is configured to allow the stand to be positioned relative to the bass drum pad when arranged in contact with the bass drum pad and the stand.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A bass drum pad and a drum kit in accordance with the present disclosure respectively embodied in a bass drum practice pad (hereafter, bass pad) and a drum practice kit will now be described with reference to FIGS. 1 to 14.

Figure 1:
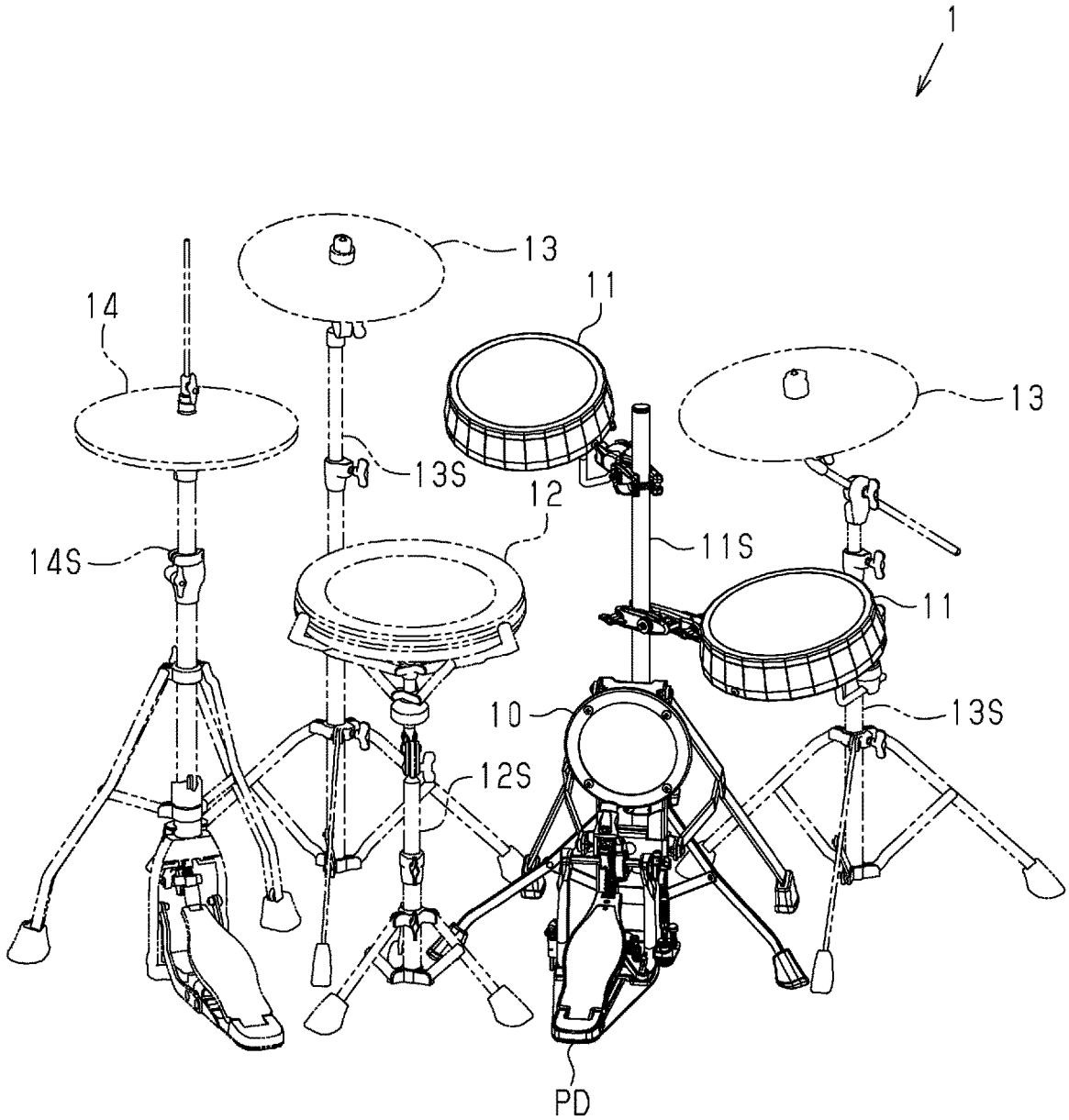
FIG. 1 is a perspective view of a drum kit in accordance with an embodiment of the present disclosure.

As shown in FIG. 1, a drum practice kit 1 includes a bass pad 10, a tom pad 11, a snare pad 12, a cymbal pad 13, and a hi-hat pad 14. The tom pad 11 is used in a state attached to a tom stand 11S. The snare pad 12 is used in a state attached to a snare stand 12S. The cymbal pad 13 is used in a state attached to a cymbal stand 13S. The hi-hat pad 14 is used in a state attached to a hi-hat stand 14S that is coupled to a pedal device. The bass pad 10 is used in a state coupled to a pedal device PD.

Figure 2:
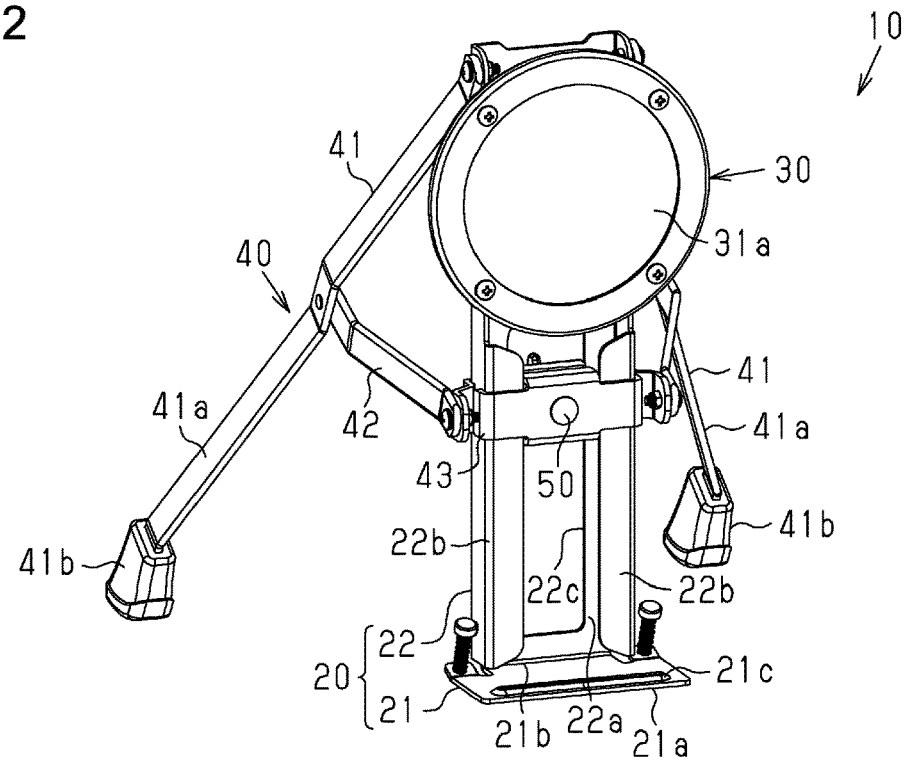
FIG. 2 is a perspective view of a bass pad in accordance with the embodiment of the present disclosure.
Figure 3:
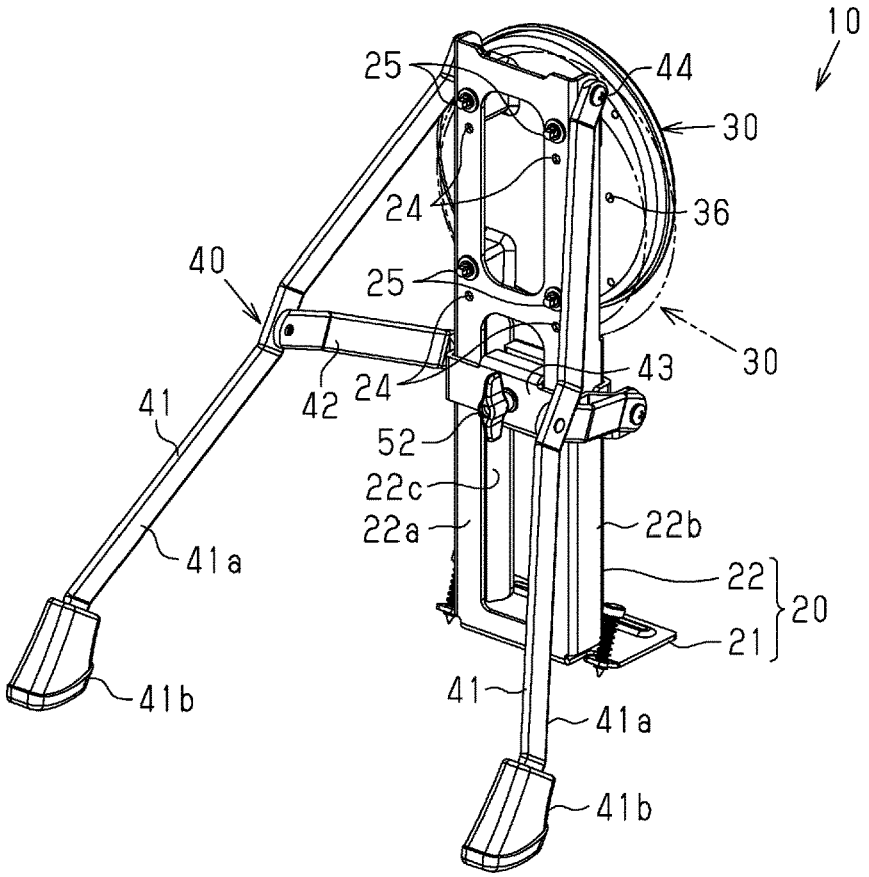
FIG. 3 is a rear perspective view of the bass pad.
Figure 4:
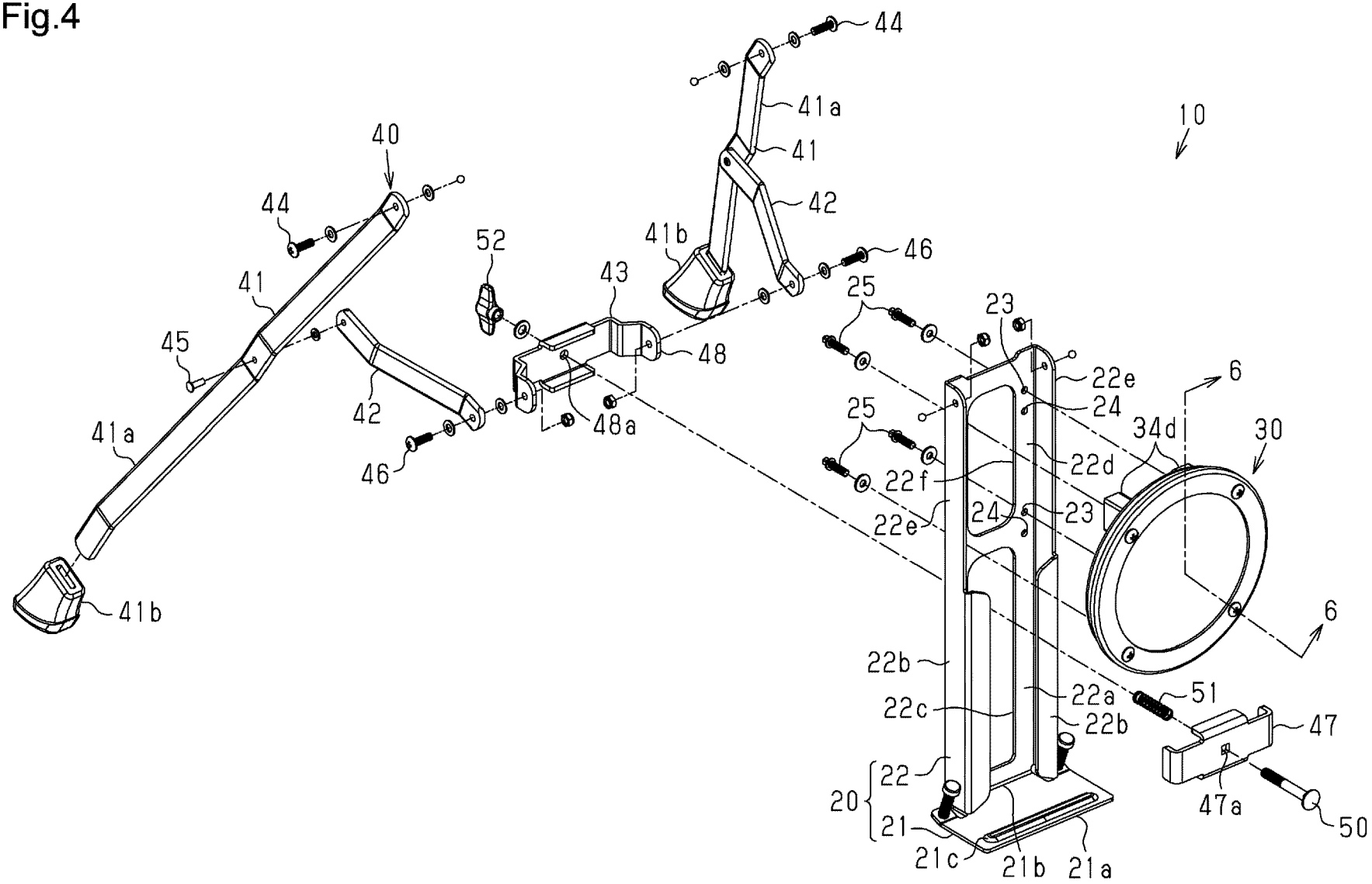
FIG. 4 is an exploded perspective view of the bass pad.

As shown in FIGS. 2 to 4, the bass pad 10 includes a frame body 20, a pad body 30, and a leg-opening mechanism 40. The pad body 30 and the leg-opening mechanism 40 are attached to the frame body 20 to form the bass pad 10.

The frame body 20 includes a pad base 21 and a main post 22 that is integrated with the pad base 21. The frame body 20 is stamped out from a single steel plate into a predetermined shape and formed by cutting out material from the steel plate and pressing the steel plate. The pad base 21 is part of the frame body 20 and is the portion fixed to a clamp of the pedal device PD, which is shown in FIG. 1. The pad base 21 has the form of a rectangular plate and includes two edges extending in the longitudinal direction. The pad base 21 includes a rib 21*c* that extends along and near a first edge 21*a*.

The main post 22 is part of the frame body 20 and extends from a second edge 21*b* of the pad base 21 in a direction orthogonal to the top surface of the pad base 21. The lower half of the main post 22 includes a lower rear wall 22*a* and two lower side walls 22*b*. The lower rear wall 22*a* extends from the second edge 21*b* of the pad base 21. The lower side walls 22*b* are arranged at two side edges of the lower rear wall 22*a*. A central part of the lower rear wall 22*a* includes a lower opening 22*c*. The lower opening 22*c* is substantially rectangular and extends in a longitudinal direction of the main post 22. The lower side walls 22*b* are L-shaped in cross section and form the two sides of the lower half of the main post 22.

The upper half of the main post 22 includes an upper rear wall 22*d* and two upper side walls 22*e*. The upper rear wall 22*d* continuously extends from the lower rear wall 22*a*. The upper side walls 22*e* are arranged at two side edges of the upper rear wall 22*d*. A central part of the upper rear wall 22*d* includes an upper opening 22*f*. The upper opening 22*f* is substantially rectangular and extends in the longitudinal direction of the main post 22. The upper opening 22*f* is shorter than the lower opening 22*c*. Further, the four corners of the upper rear wall 22*d* each include an upper hole 23 and a lower hole 24. A bolt 25 is inserted through each of the upper holes 23 and the lower holes 24 to couple the pad body 30 to the main post 22. The upper side walls 22*e* are flat and form the two sides of the upper half of the main post 22.

Figure 5:
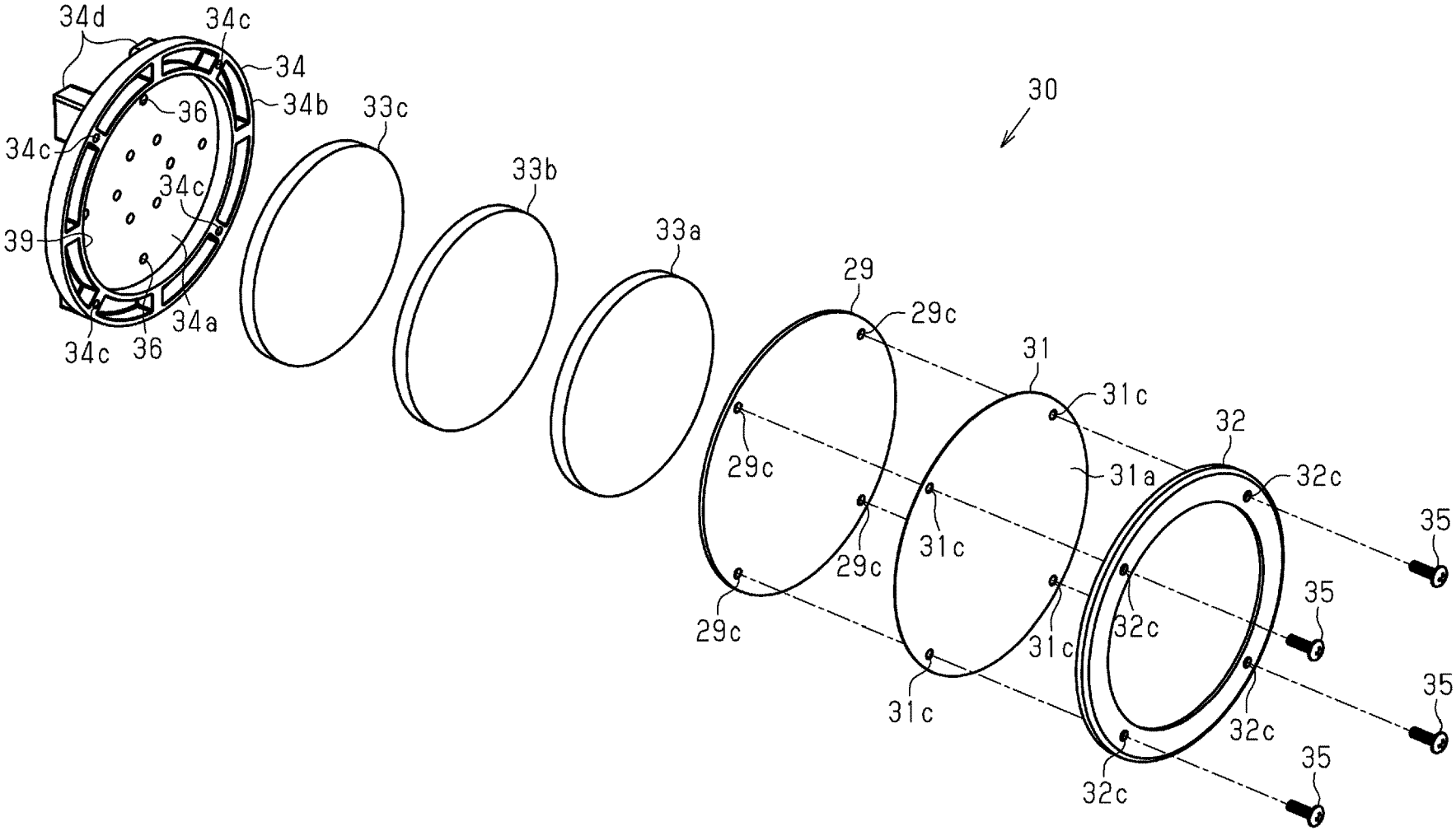
FIG. 5 is an exploded perspective view of a pad body.
Figure 6:
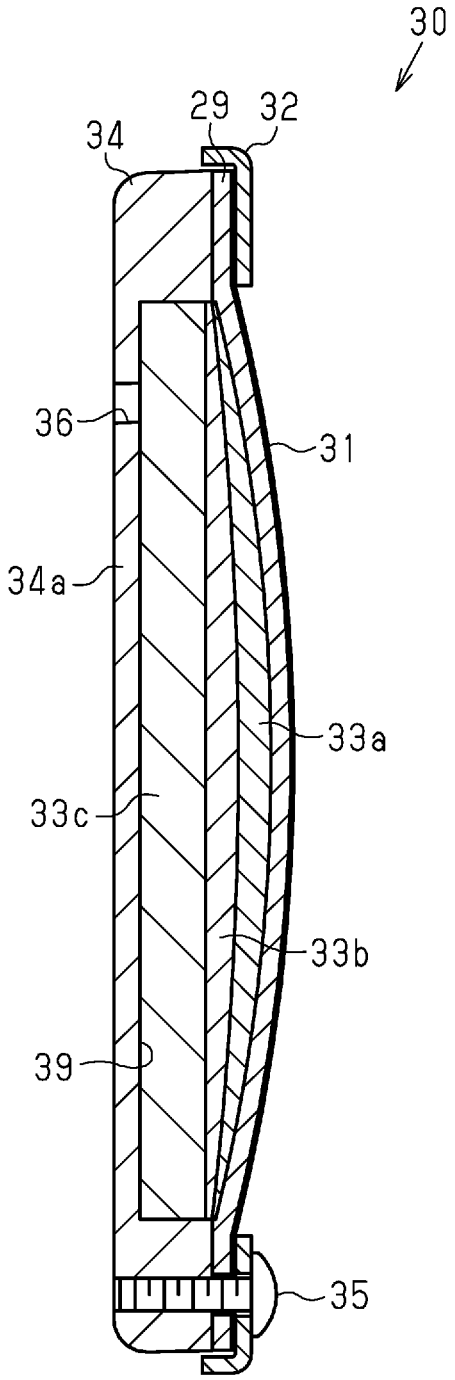
FIG. 6 is a cross-sectional view taken along line 6-6 in FIG. 4.

As shown in FIGS. 5 and 6, the pad body 30 includes a batter surface member 31, an inner sheet 29, a pad cover 32, impact absorption members 33*a*, 33*b*, and 33*c*, and a body member 34. The batter surface member 31, the inner sheet 29, the pad cover 32, the impact absorption members 33*a*, 33*b*, and 33*c*, and the body member 34 are coaxially arranged and integrally coupled to one another to form the pad body 30.

The batter surface member 31 is a circular sheet. The batter surface member 31 uses a cloth as a material to produce sound and a beating feel similar to the sound and beating feel that would be produced with a bass drum. The batter surface member 31 includes a batter surface 31*a* that is beaten by the pedal device PD, which is shown in FIG. 1. Four insertion holes 31*c* are formed at equal angular intervals near the outer circumference of the batter surface member 31. The inner sheet 29 is a circular rubber sheet. Four insertion holes 29*c* are formed at equal angular intervals near the circumference of the inner sheet 29.

The pad cover 32 is a ring-shaped plate. The pad cover 32 includes four insertion holes 32*c* at equal angular intervals. Screws 35 are inserted through the insertion holes 29*c* of the inner sheet 29, the insertion holes 31*c* of the batter surface member 31, and the insertion holes 32*c* of the pad cover 32 to fix the pad cover 32, the batter surface member 31, and the inner sheet 29 to the body member 34.

The body member 34 is cylindrical and has a closed bottom. The body member 34 includes a circular bottom plate portion 34*a* and a tubular portion 34*b* that is arranged on the circumference of the bottom plate portion 34*a*. The tubular portion 34*b* includes four threaded holes 34*c* at equal angular intervals. The threaded holes 34*c* receive the screws 35, which are inserted through the insertion holes 29*c* of the inner sheet 29, the insertion holes 31*c* of the batter surface member 31, and the insertion holes 32*c* of the pad cover 32. The body member 34 includes a circular cavity 39 defined by the bottom plate portion 34*a* and an inner circumferential surface of the tubular portion 34*b*.

The impact absorption members 33*a*, 33*b*, and 33*c* are formed by disc-shaped sponge-like materials. Among the impact absorption members 33*a*, 33*b*, and 33*c*, the impact absorption members 33*a* and 33*b* that are located closer to the inner sheet 29 are formed by a relatively soft sponge-like material. Further, the impact absorption member 33*c* that is located closer to the body member 34 is formed by a relatively hard sponge-like material. The impact absorption members 33*a*, 33*b*, and 33*c* are arranged in the open space inside the pad body 30 to absorb the impact produced when beating the batter surface member 31 with the pedal device PD.

The bottom plate portion 34*a* includes ten air holes 36. The ten air holes 36 are spaced apart from one another and arranged symmetrically in vertical and transverse directions over the entire bottom plate portion 34*a* about the center of the bottom plate portion 34*a*. The number and size of the air holes 36 are set in accordance with the prototypes and experiment results so that the sound and beating feeling produced when beating the pad body 30 become similar to the sound and beating feel of a bass drum.

As shown in FIG. 6, only the impact absorption member 33*c* is accommodated in the cavity 39 of the pad body 30. The impact absorption members 33*a* and 33*b* are arranged outward from the cavity 39 of the pad body 30 on the surface of the impact absorption member 33*c*. The batter surface member 31 and the inner sheet 29 are attached to the body member 34 to entirely cover the surface of the impact absorption member 33*a* and to press the impact absorption members 33*a* and 33*b* from the batter surface 31*a*. The batter surface member 31, and the inner sheet 29 are fixed with the pad cover 32 to the body member 34 by the screws 35.

The portion of the pad body 30 including the batter surface member 31, the inner sheet 29, and the impact absorption members 33*a* and 33*b* is convex so that the feel when beating the batter surface member 31 becomes similar to the beating feel of a bass drum. Further, the inner sheet 29 seals the inner space of the pad body 30 to prevent the air in the pad body 30 from escaping through the batter surface member 31 when the batter surface member 31 is beaten. Specifically, the pad body 30 is configured so that the air in the pad body 30 escapes through only the air holes 36 when the batter surface member 31 is beaten.

As shown in FIGS. 3 to 5, four fastening portions 34*d* projecting from the rear surface of the body member 34 are fastened to the main post 22. Each fastening portion 34*d* includes a threaded hole to receive a bolt 25. When the four fastening portions 34*d* are fastened to the upper holes 23 of the main post 22, the pad body 30 is attached at a first position indicated by the solid lines in FIG. 3. When the four fastening portions 34*d* are fastened to the lower holes 24 of the main post 22, the pad body 30 is attached at a second position indicated by the double-dashed lines in FIG. 3. The first position is set upward from the second position and aligned with the second position in an axial direction of the main post 22. The coupling position of the pad body 30 on the main post 22 is changeable in the axial direction of the main post 22.

As shown in FIGS. 2 to 4, the leg-opening mechanism 40 includes two legs 41, two stays 42, and a sliding member 43. Each leg 41 includes a leg plate 41*a* and a rubber stopper 41*b*. The leg plates 41*a* are coupled to the main post 22. Each stopper 41*b* is attached to the distal end of the leg plate 41*a*. The leg plates 41*a* are longer than the main post 22. The proximal ends of the leg plates 41*a* are pivotally connected to the upper ends of the two side portions of the main post 22 by screws 44. The two legs 41 are symmetrically arranged and coupled to the main post 22 so that the distance between the legs 41 increases toward the lower end of the main post 22. The stoppers 41*b* contact the setting surface, on which the bass pad 10 is set, to prevent the bass pad 10 from slipping on the setting surface.

The two stays 42 connect the two legs 41 and the sliding member 43. Each stay 42 is pivotally connected to a central part of the corresponding leg 41 by a rivet 45 and is pivotally connected to the sliding member 43 by a screw 46.

The sliding member 43 includes a front member 47 and a rear member 48. A central part of the front member 47 includes an insertion hole 47*a*, and a central part of the rear member 48 includes an insertion hole 48*a*. A bolt 50 is inserted through the insertion holes 47*a* and 48*a* to couple the front member 47 and the rear member 48 and attach the sliding member 43 to the main post 22. The front member 47 and the rear member 48 sandwich the main post 22 from the front side and the rear side and are attached to the main post 22 to form the sliding member 43.

A coil spring 51 is fitted onto the shaft of the bolt 50 that is located inside the sliding member 43. Further, a wingnut 52 is fastened to the distal end of the bolt 50 that is located outside the sliding member 43. When the wingnut 52 is tightened to the bolt 50, the sliding member 43 is fixed to the main post 22 by the force of the front member 47 and the rear member 48 sandwiching the main post 22. When the wingnut 52 is loosened, the force of the front member 47 and the rear member 48 sandwiching the main post 22 is weakened so that the sliding member 43 becomes slidable relative to the main post 22.

Figure 7:
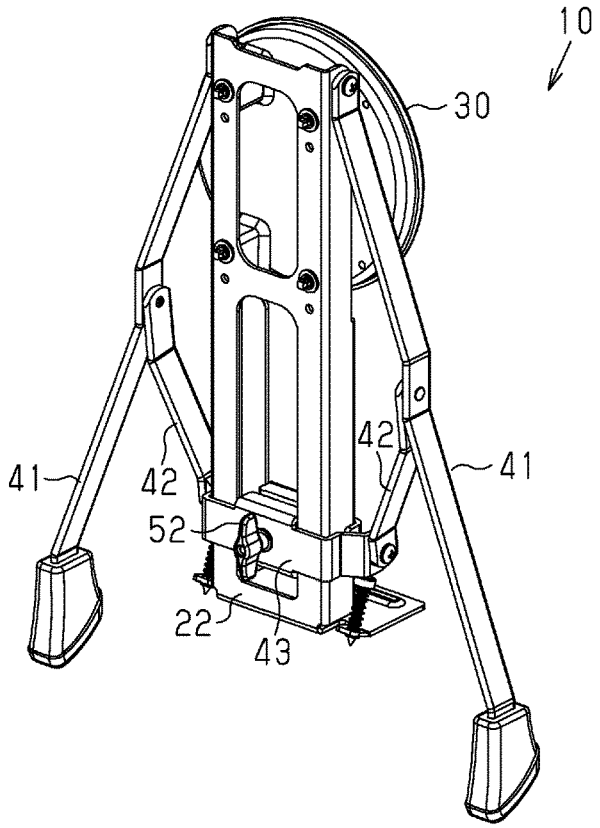
FIG. 7 is a perspective view of the bass pad in a state in which legs and stays are closed.
Figure 8:
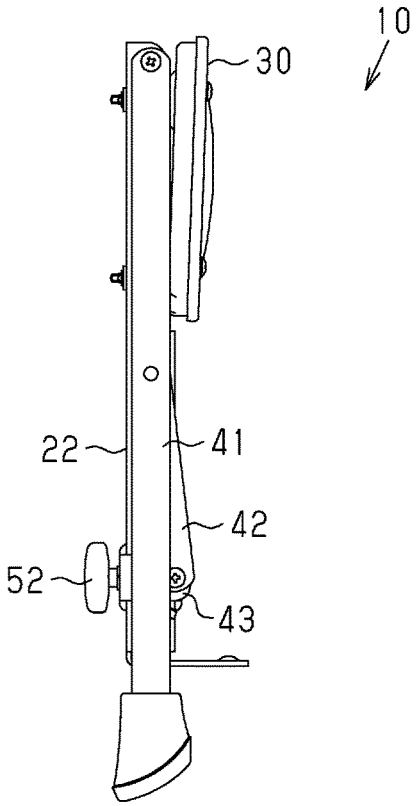
FIG. 8 is a side view of the bass pad shown in FIG. 7.

As shown in FIGS. 2, 3, 7 and 8, the sliding member 43 is slidable in the axial direction of the main post 22 between an upper limit position shown in FIGS. 2 and 3 and a lower limit position shown in FIGS. 7 and 8. When the sliding member 43 is moved in the axial direction of the main post 22, the legs 41 are pivoted about the screws 44 and the stays 42 are pivoted about the screws 46 to open and close the legs 41 and the stays 42 with respect to the main post 22.

To use the bass pad 10, the sliding member 43 is located at the upper limit position on the main post 22 so that the legs 41 and the stays 42 are fully open from the main post 22. Further, the wingnut 52 is tightened to the bolt 50 to fix the sliding member 43 at the upper limit position on the main post 22 to hold the legs 41 and the stays 42 in the open state from the main post 22.

To store the bass pad 10, the sliding member 43 is located at the lower limit position on the main post 22 so that the legs 41 and the stays 42 are closed with respect to the main post 22. Further, the wingnut 52 is tightened to the bolt 50 to fix the sliding member 43 at the lower limit position on the main post 22 to hold the legs 41 and the stays 42 in the closed state with respect to the main post 22. In such a state, the legs 41 are parallel to the main post 22. The stays 42 are substantially parallel to the main post 22. In other words, as viewed in an axial direction of the screws 44 and 46, the legs 41 and the stays 42 overlap the main post 22.

A positioning structure of the bass pad 10 and the tom stand 11S will now be described with reference to FIGS. 9 to 11.

Figure 9:
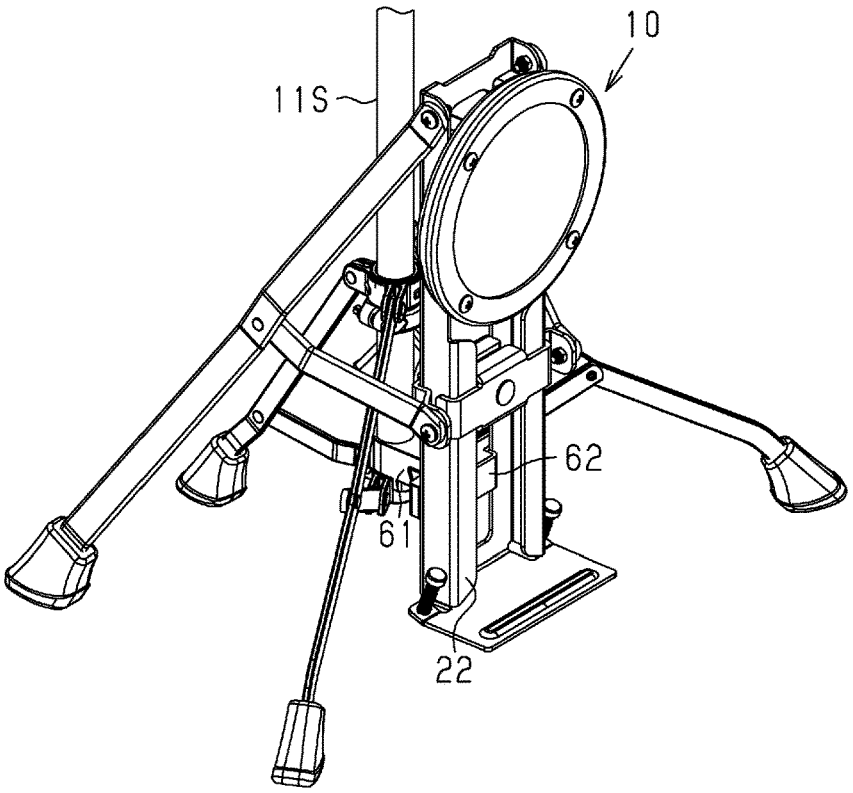
FIG. 9 is a perspective view illustrating a positioning structure for a tom stand relative to the bass pad using a positioning member.
Figure 10:
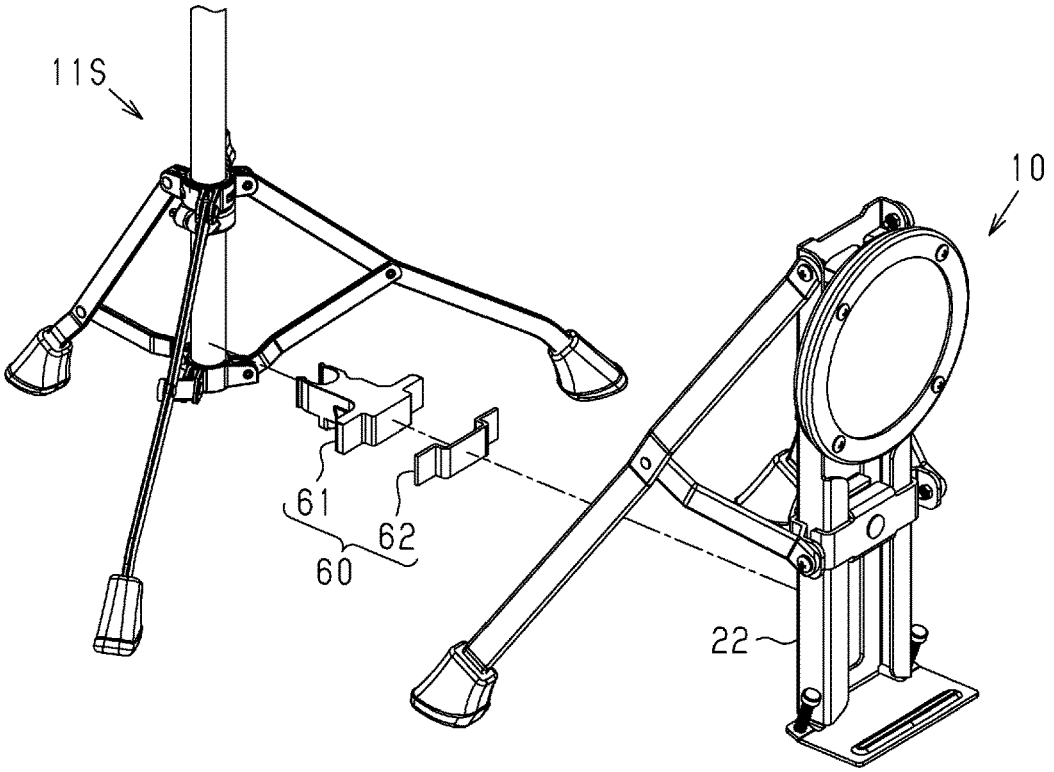
FIG. 10 is a perspective view illustrating the positioning structure for the tom stand relative to the bass pad using the positioning member.

As shown in FIGS. 9 and 10, the tom stand 11S is set so that the bass pad 10 is located between the tom stand 11S and the pedal device PD, which is shown in FIG. 1. A positioning member 60 is used is this setting to position the tom stand 11S relative to the bass pad 10. The positioning member 60 includes a positioning body 61 and a damper 62.

Figure 11:
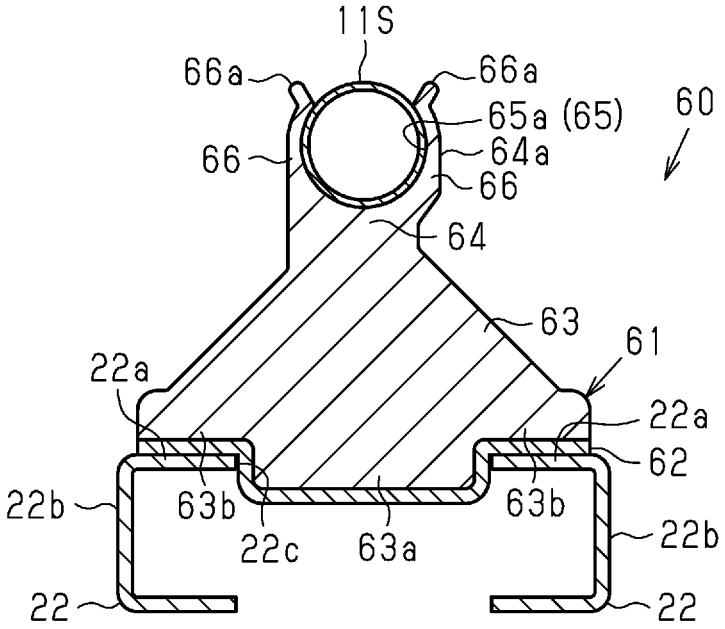
FIG. 11 is a cross-sectional view illustrating the positioning structure for the tom stand relative to the bass pad using the positioning member.

As shown in FIG. 11, the positioning body 61 includes a first positioning portion 63 and a second positioning portion 64 that is arranged integrally with the top part of the first positioning portion 63. The first positioning portion 63 has a substantially triangular cross section. The second positioning portion 64 is substantially tubular. The positioning body 61 is formed from a resin.

The first positioning portion 63 includes a fitting projection 63*a* and two flat portions 63*b*. The fitting projection 63*a* serves as a first fitting portion. The flat portions 63*b* are arranged at the two sides of the fitting projection 63*a*. The fitting projection 63*a* has a rectangular cross section. The fitting projection 63*a* and the damper 62 are fitted in the lower opening 22*c* of the main post 22. The flat portions 63*b* are faced toward the lower rear wall 22*a* of the main post 22 in a state in which the damper 62 is arranged between the flat portions 63*b* and the main post 22.

The damper 62 has the form of a rectangular plate shape to have a substantially U-shaped cross section. The cross-sectional shape of the damper 62 conforms to the cross-sectional shape of the first positioning portion 63 where the fitting projection 63*a* and the flat portions 63*b* are included. The damper 62 is arranged and used between the positioning body 61 and the bass pad 10. When the bass pad 10 is played, the damper 62 absorbs the beating impact and vibration of the batter surface member 31. The damper 62 is formed from a material, specifically, rubber, urethane, felt, or the like, having superior impact absorption and vibration absorption properties.

The second positioning portion 64 includes a fitting recess 65 that serves as a second fitting portion. The fitting recess 65 includes an arced inner circumferential surface 65*a*. The second positioning portion 64 includes two walls 66 extending between an outer surface 64*a* of the second positioning portion 64 and the inner circumferential surface 65*a* of the fitting recess 65. Each wall 66 includes a ledge 66*a* that extends outward from the distal end of the wall 66 in a radial direction of the fitting recess 65. The second positioning portion 64 is formed to be snap-fitted to the pipe of the tom stand 11S by flexing the walls 66. In other words, the second positioning portion 64 is formed to fit and hold the pipe in the fitting recess 65.

The operation of the bass pad 10 will now be described with reference to FIGS. 12 to 14.

Figure 12:
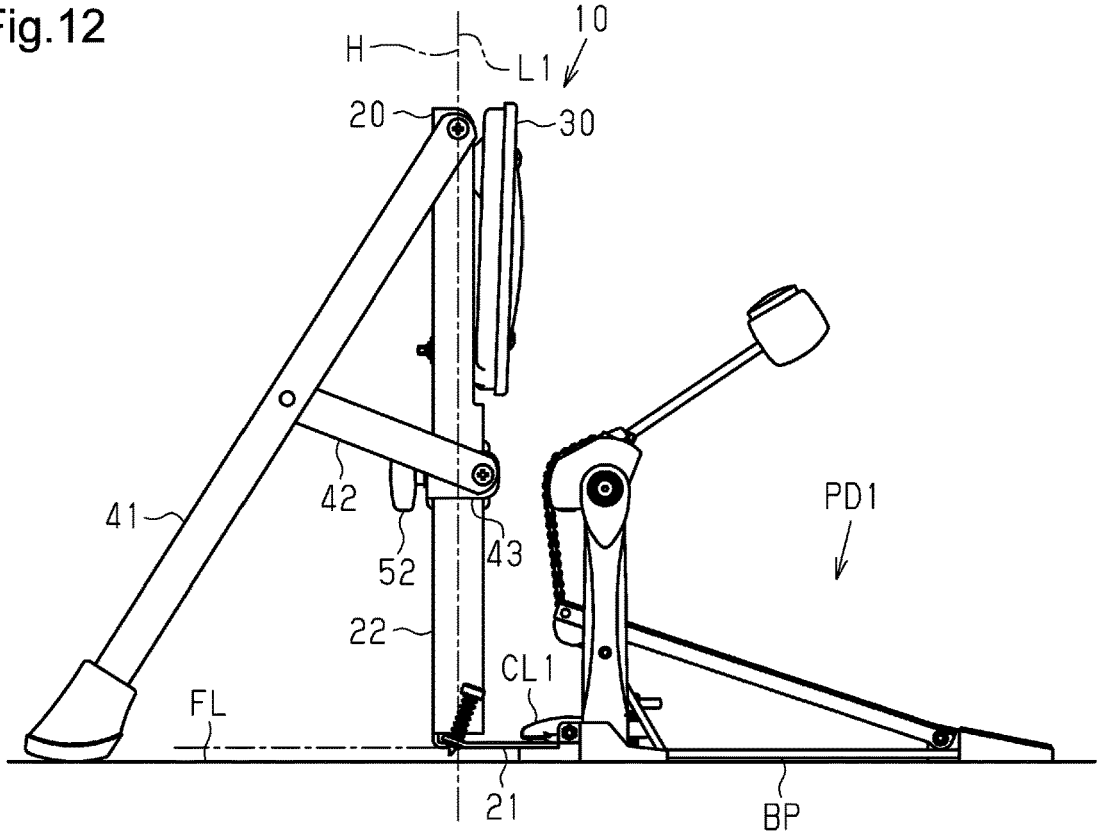
FIG. 12 is a schematic diagram illustrating the operation of the bass pad.
Figure 13:
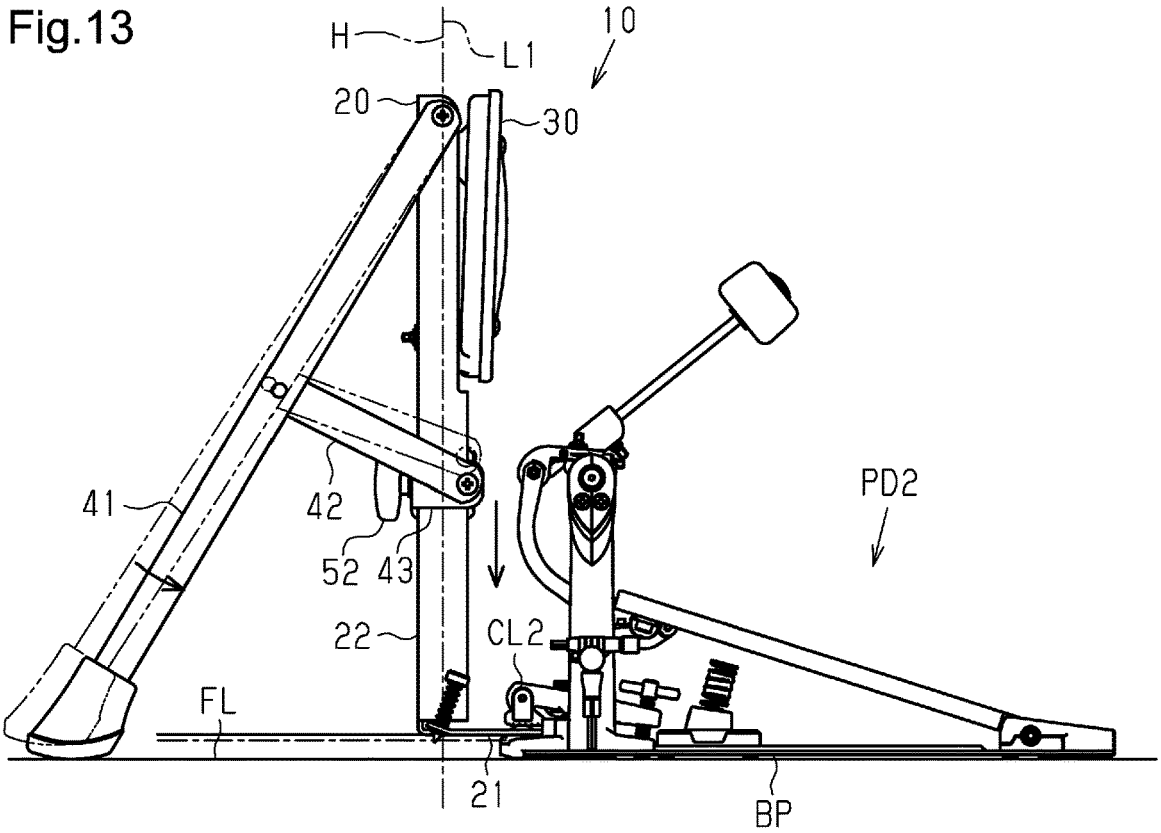
FIG. 13 is a schematic diagram illustrating the operation of the bass pad.
Figure 14:
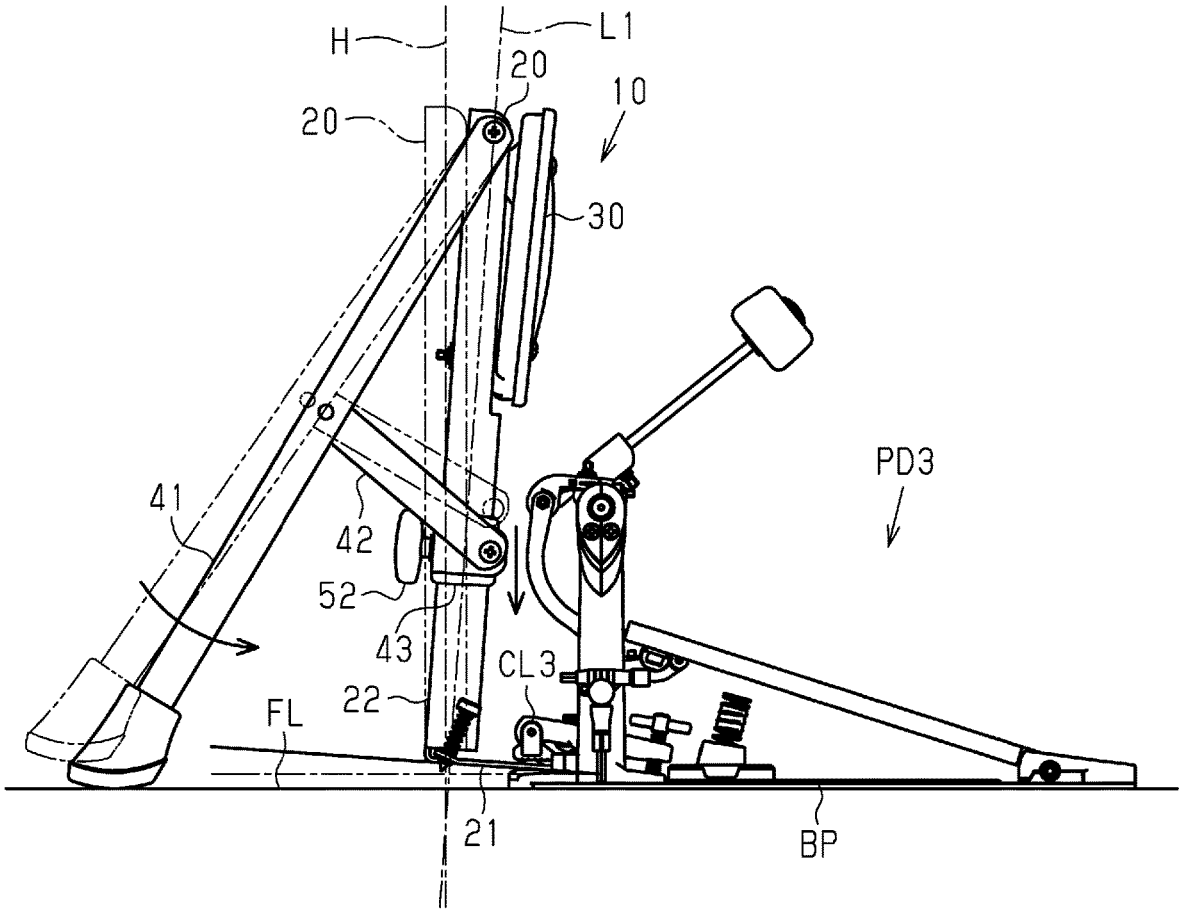
FIG. 14 is a schematic diagram illustrating the operation of the bass pad.

FIG. 12 shows a state in which a first pedal device PD1 is coupled to the bass pad 10, FIG. 13 shows a state in which a second pedal device PD2 is coupled to the bass pad 10, and FIG. 14 shows a state in which a third pedal device PD3 is coupled to the bass pad 10. As shown in FIGS. 12 and 13, a clamp CL2 of the second pedal device PD2 is higher than a clamp CL1 of the first pedal device PD1. Further, as shown in FIG. 12, the clamp CL1 is parallel to a bottom surface of a base plate BP of the first pedal device PD1. In contrast, as shown in FIG. 14, a clamp CL3 of the third pedal device PD3 is diagonal to the bottom surface of the base plate BP.

As shown in FIGS. 12 to 14, the bass pad 10 is configured so that the height and angle of the pad base 21 are adjustable in accordance with the open amount of the legs 41 from the main post 22. The height of the pad base 21 corresponds to the position of the main post 22 along orthogonal line H that is orthogonal to the setting surface FL on which the bass pad 10 is set. The angle of the pad base 21 is the angle of axis L1 of the main post 22 relative to the orthogonal line H, which is orthogonal to the setting surface FL. Further, the bass pad 10 is configured so that the height and angle of the pad base 21 are adjustable in a state in which the pad base 21 is separated from the setting surface FL. Also, the bass pad 10 is configured so that the position of the distal ends of the legs 41 is adjustable in a state coupled to the clamp of the pedal device PD.

A series of operations for coupling the bass pad 10 to the pedal device in accordance with the height of the clamp of the pedal device will now be described with reference to FIGS. 12 and 13.

With reference to FIGS. 12 and 13, when coupling the bass pad 10 to the second pedal device PD2 after separating the bass pad 10 from the first pedal device PD1, the pad base 21 of the bass pad 10 is first fixed to the clamp CL2 of the second pedal device PD2. This connects the bass pad 10 to the second pedal device PD2 in accordance with the height of the clamp CL2. The clamp CL2 is parallel to the bottom surface of the base plate BP of the second pedal device PD2, that is, the setting surface FL. Thus, when the pad base 21 is fixed to the clamp CL2, the main post 22 is arranged on the setting surface FL with the axis L1 parallel to the orthogonal line H. In this manner, the bass pad 10 is positioned on the setting surface FL so that the main post 22 is disposed perpendicular to the setting surface FL.

Subsequently, the position of the distal ends of the legs 41 is adjusted to stabilize the form of the bass pad 10 on the setting surface FL. In a state in which the wingnut 52 is loosened, the sliding member 43 is moved along the axis L1 of the main post 22 to adjust the open amount of the legs 41 and the stays 42 from the main post 22. Then, the wingnut 52 is tightened to the bolt 50 to fix the sliding member 43 to the main post 22 at a position where the distal ends of the legs 41 are located on the same plane as the bottom surface of the base plate BP. This fixes the height of the pad base 21 with the legs 41 and the stays 42 held in a state open from the main post 22. In such a state, the bass pad 10 is supported by the legs 41 and the pedal device PD. This stabilizes the form of the bass pad 10 on the setting surface FL. The series of operations are performed in a state in which the pad base 21 is separated from the setting surface FL.

A series of operations for coupling the bass pad 10 to the pedal device in accordance with the angle of the clamp of the pedal device will now be described with reference to FIGS. 12 and 14.

With reference to FIGS. 12 and 14, when coupling the bass pad 10 to the third pedal device PD3 after separating the bass pad 10 from the first pedal device PD1, the pad base 21 of the bass pad 10 is first fixed to the clamp CL3 of the third pedal device PD3. This connects the bass pad 10 to the third pedal device PD3 in accordance with the angle of the clamp CL3. The clamp CL3 is diagonal to the bottom surface of the base plate BP of the third pedal device PD3, that is, the setting surface FL. Thus, when the pad base 21 is fixed to the clamp CL3, the main post 22 is set on the setting surface FL with the axis L1 diagonal to the orthogonal line H. In this manner, the bass pad 10 is positioned on the setting surface FL with the main post 22 tilted from the orthogonal line H.

Then, the position of the distal ends of the legs 41 is adjusted to stabilize the form of the bass pad 10 on the setting surface FL. In a state in which the wingnut 52 is loosened, the sliding member 43 is moved along the axis L1 of the main post 22 to adjust the open amount of the legs 41 and the stays 42 from the main post 22. Then, the wingnut 52 is tightened to the bolt 50 to fix the sliding member 43 to the main post 22 at a position where the distal ends of the legs 41 are located on the same plane as the bottom surface of the base plate BP. This fixes the height of the pad base 21 with the legs 41 and the stays 42 held in the state open from the main post 22. In such a state, the bass pad 10 is supported by the legs 41 and the pedal device PD. This stabilizes the form of the bass pad 10 on the setting surface FL. The series of operations are performed in a state in which the pad base 21 is separated from the setting surface FL.

The present embodiment has the following advantages.

(1) The bass pad 10 is configured so that the height and angle of the pad base 21 are adjustable. The height of the pad base 21 is the position of the main post 22 corresponding to the height of the clamp of the pedal device PD along the orthogonal line H that is orthogonal to the setting surface FL on which the bass pad 10 is set. The angle of the pad base 21 is the angle of the axis L1 of the main post 22 relative to the orthogonal line H, which is orthogonal to the setting surface FL, and corresponds to the angle of the clamp of the pedal device PD. Thus, the adjustable height and angle of the pad base 21 allow the bass pad 10 to be coupled to various types of pedal devices PD in accordance with both the height and angle of the clamp. Further, the main post 22 is formed integrally with the pad base 21, which is fixed to the clamp. Specifically, the bass pad 10 does not include a part that adjusts the coupling angle of the pad base 21 and the portion of the bass pad 10 fixed to the clamp. Thus, even when the pedal is repetitively depressed and the force of angular momentum intermittently acts on the portion fixed to the clamp, the main post 22 and the pad body 30 will not be displaced from the adjusted position. This improves the stability of the bass pad 10 when set to be coupled to the pedal device PD.

(2) The bass pad 10 is configured so that the height and angle of the pad base 21 are adjustable in a state in which the pad base 21 is separated from the setting surface FL. With this structure, the pad base 21 is separated from the setting surface FL so that the pad base 21 will not interfere with the setting surface FL when adjusting the height and angle of the pad base 21. This readily couples the bass pad 10 to the pedal device PD in accordance with both the height and angle of the clamp. Further, the form of the bass pad 10 is readily stabilized on the setting surface FL.

(3) The bass pad 10 is configured so that the position of the distal ends of the legs 41 is adjustable in a state coupled to the clamp of the pedal device PD. With this structure, the position of the distal ends of the legs 41 can be adjusted so that the distal ends of the legs 41 are set on the setting surface FL in a state in which the bass pad 10 is coupled to the clamp. This allows the distal ends of the legs 41 of the bass pad 10 to be arranged on the same plane as the bottom surface of the pedal device PD after the bass pad 10 is coupled to the clamp. In this manner, the bass pad 10 is supported by the legs 41 and the pedal device PD. This stabilizes the form of the bass pad 10 on the setting surface FL.

(4) The bass pad 10 is configured so that the height and angle of the pad base 21 are adjustable in accordance with the open amount of the legs 41. With this structure, the bass pad 10 is readily coupled to the pedal device PD in accordance with both the height and angle of the clamp. Also, the position of the distal ends of the legs 41 is adjustable in accordance with the open amount of the legs 41 so that the distal ends of the legs 41 of the bass pad 10 are readily arranged on the same plane as the bottom surface of the pedal device PD. Accordingly, the form of the bass pad 10 on the setting surface FL is readily stabilized.

(5) When the wingnut 52 is loosened, the sliding member 43 becomes slidable in the axial direction of the main post 22. When the sliding member 43 is simply moved relative to the main post 22, the legs 41 and the stays 42 are opened and closed with respect to the main post 22 so that the height and angle of the pad base 21 are adjusted. In this manner, the bass pad 10 is readily coupled to the pedal device PD in accordance with both the height and angle of the clamp, and the form of the bass pad 10 on the setting surface FL is readily stabilized. Also, when the wingnut 52 is tightened to the bolt 50, the sliding member 43 is fixed to the main post 22. This holds the legs 41 and the stays 42 in the state open from the main post 22 and fixes the height and angle of the pad base 21. This further improves the stability of the bass pad 10 on the setting surface when coupled to the pedal device PD.

The sliding member 43 is coupled to the stays 42, which are attached to the main post 22 in a manner allowing the stays 42 to open and close with respect to the main post 22. Further, the direction in which the sliding member 43 is moved relative to the main post 22 coincides with the axial direction of the main post 22 and differs greatly from the direction in which the stays 42 are opened from the main post 22. In this case, since the sliding direction of the sliding member 43 differs greatly from the opening direction of the legs 41 and the stays 42, the legs 41 and the stays 42 will not open when the pedal is depressed even though the depression of the pedal produces force acting on the legs 41 and the stays 42 in the opening direction of the legs 41 and the stays 42 from the main post 22.

(6) The sliding member 43 is slidable in the axial direction of the main post 22 between the upper limit position shown in FIGS. 2 and 3 and the lower limit position shown in FIGS. 7 and 8. With this structure, to use the bass pad 10, the height and angle of the pad base 21 can be adjusted by moving the sliding member 43 between the upper limit position and the lower limit position on the main post 22. To store the bass pad 10, the sliding member 43 is moved to the lower limit position on the main post 22. Thus, the relationship is clear between the position of the sliding member 43 on the main post 22 and the open and closed state of the legs 41 and the stays 42. This improves handling of the bass pad 10.

(7) To store the bass pad 10, the legs 41 and the stays 42 can be disposed substantially parallel to the main post 22 by moving the sliding member 43 to the lower limit position on the main post 22. This allows the bass pad 10 to be compact when stored.

(8) The leg-opening mechanism 40 includes two legs 41 and two stays 42. With this structure, the three-point support of the two legs 41 and the pedal device PD further improves the stability of the bass pad 10 when the bass pad 10 is set to be coupled to the pedal device PD.

(9) The coupling position of the pad body 30 on the main post 22 is changeable in the axial direction of the main post 22. With this structure, the height of the pad body 30, which corresponds to the linear distance from the setting surface FL to the center of the pad body 30, is changeable. This allows the height of the pad body 30 to be adjusted in accordance with the type of the pedal device PD so that the center of the pad body 30 can be beaten.

(10) The tom stand 11S is set so that the bass pad 10 is located between the tom stand 11S and the pedal device PD. In this setting, the positioning member 60 is used to position the tom stand 11S relative to the bass pad 10. In this case, the positioning member 60 easily positions the tom stand 11S relative to the bass pad 10 and facilitates the setting of the drum practice kit 1.

Also, the tom stand 11S is positioned relative to the bass pad 10 so that the total weight of the bass pad 10 and the tom stand 11S restricts movement of the bass pad 10 and the tom stand 11S when playing the drum practice kit 1. This improves the stability of the bass pad 10 and the tom stand 11S in a set state. Further, the bass pad 10 will not interfere with the tom stand 11S when playing the drum practice kit 1. This prevents noise or damage that may be caused by contact of the bass pad 10 and the tom stand 11S.

(11) The positioning body 61 includes the first positioning portion 63 and the second positioning portion 64. The first positioning portion 63 includes the fitting projection 63*a*. The second positioning portion 64 includes the fitting recess 65. This structure allows the tom stand 11S to be positioned relative to the bass pad 10 by simply fitting the pipe of the tom stand 11S in the fitting recess 65 and fitting the fitting projection 63*a* in the lower opening 22*c* of the main post 22. In other words, the positioning member 60 allows for further easy positioning of the tom stand 11S relative to the bass pad 10 and further facilitates setting of the drum practice kit 1.

(12) The positioning member 60 includes the positioning body 61 and the damper 62. In a state in which the bass pad 10 and the tom stand 11S are positioned by the positioning member 60, the damper 62 and the fitting projection 63*a* are fitted in the lower opening 22*c* of the main post 22. Further, the damper 62 is arranged between the flat portions 63*b* and the main post 22. With this structure, the damper 62 absorbs the impact and vibration produced when the bass pad 10 is beaten. This reduces the noise generated when playing the drum practice kit 1 and improves quietness of the drum practice kit 1.

The present embodiment may be modified as follows.

A drum kit does not have to be embodied in the drum practice kit 1 and may be embodied in an electronic drum set. Moreover, the bass pad 10 does not have to be embodied in a practice pad for a bass drum and may be embodied in the bass pad 10 that is part of an electronic drum set.

The drum practice kit 1 includes the tom pad 11, the snare pad 12, the cymbal pad 13, and the hi-hat pad 14 as percussion instrument pads besides the bass pad 10. However, the drum practice kit 1 may include only necessary ones of the above pads.

Figure 15:
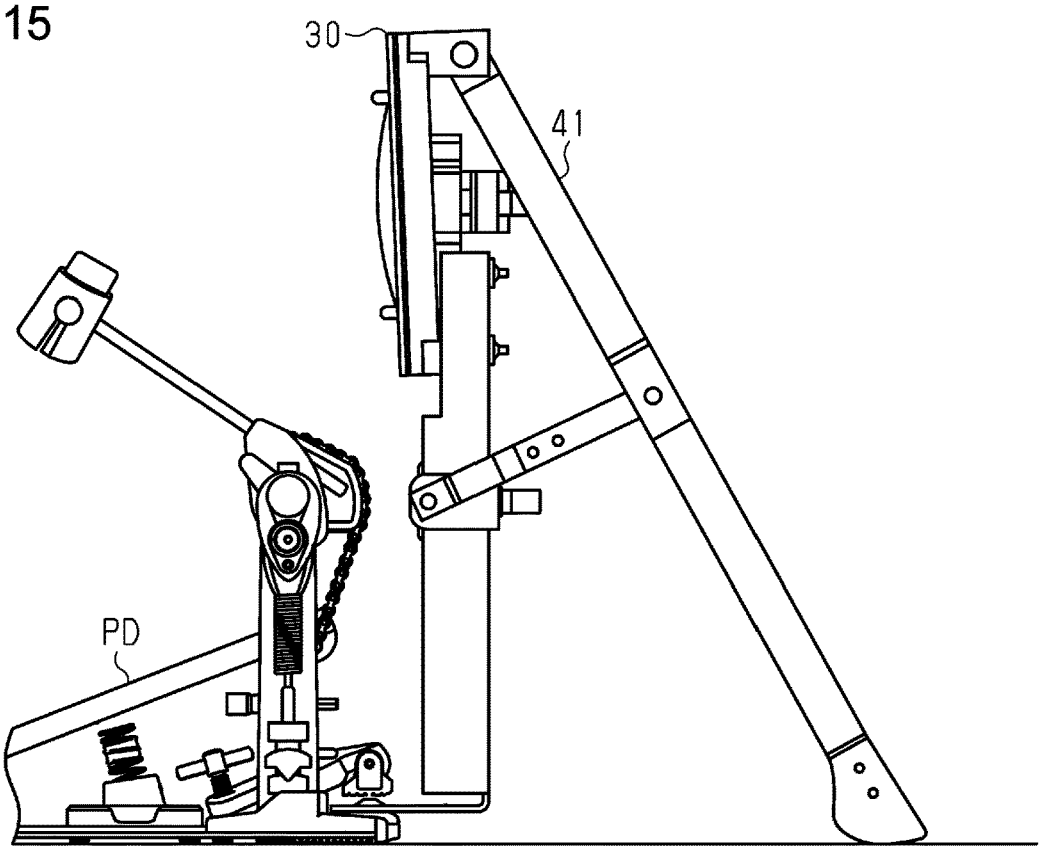
FIG. 15 is a side view showing a bass pad of another example.

The two legs 41 of the bass pad 10 do not have to be coupled to the main post 22 and may be coupled to the pad body 30, as shown in FIG. 15.

The pad base 21 and the main post 22 do not have to be formed integrally with the frame body 20 and may be separate from the frame body 20. In this case, the pad base 21 may be connected to the main post 22 by fasteners such as screws to form the frame body 20.

Figure 16:
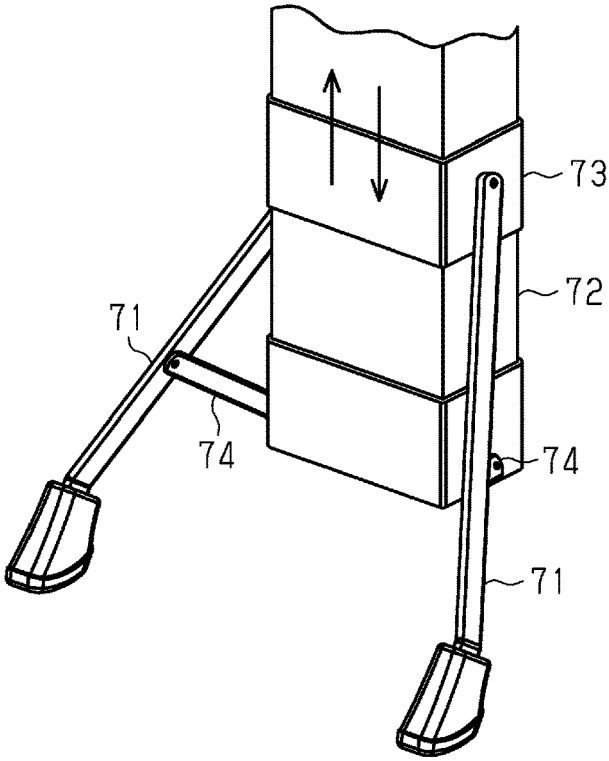
FIG. 16 is a perspective view showing part of a bass pad of a further example.

The two stays 42 do not have to connect the two legs 41 to the sliding member 43 and may connect two legs 71 to a lower end of a main post 72, as shown in FIG. 16. In this case, the two legs 71 are coupled to a sliding member 73, and stays 74 are coupled to the central parts of the two legs 71. This structure also allows the legs 71 and the stays 74 to be opened and closed with respect to the main post 72 by moving the sliding member 73 in the axial direction of the main post 72.

Figure 17:
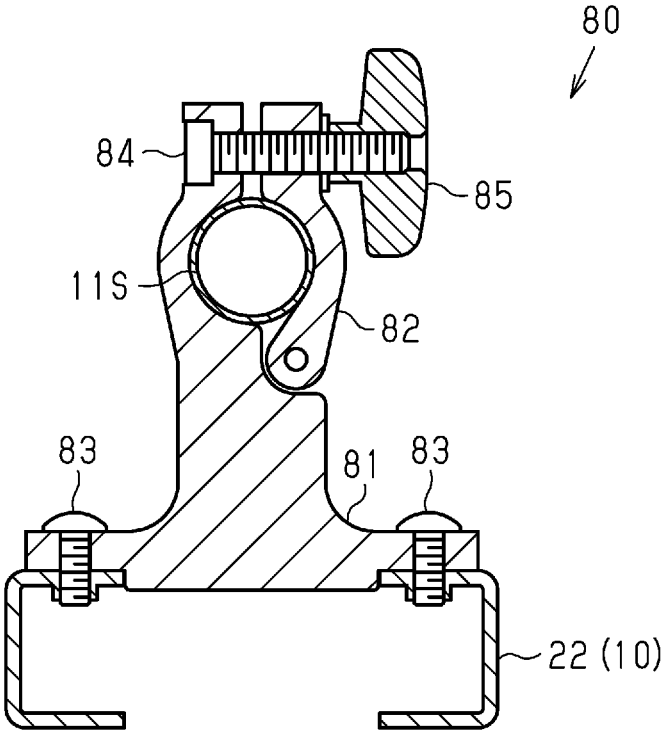
FIG. 17 is a cross-sectional view illustrating a positioning structure for a tom stand relative to a bass pad using a positioning member of a further example.
Figure 18:
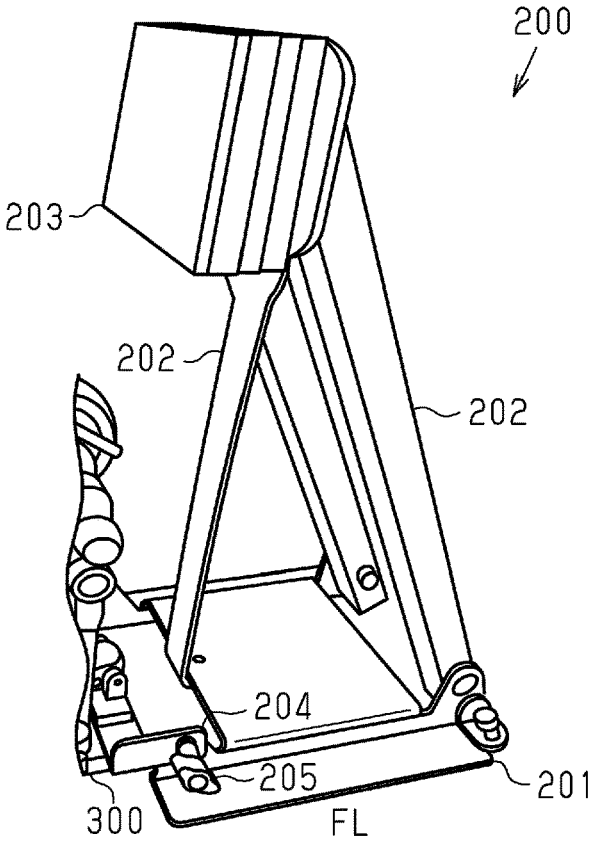
FIG. 18 is a perspective view of a known bass pad.
Figure 19:
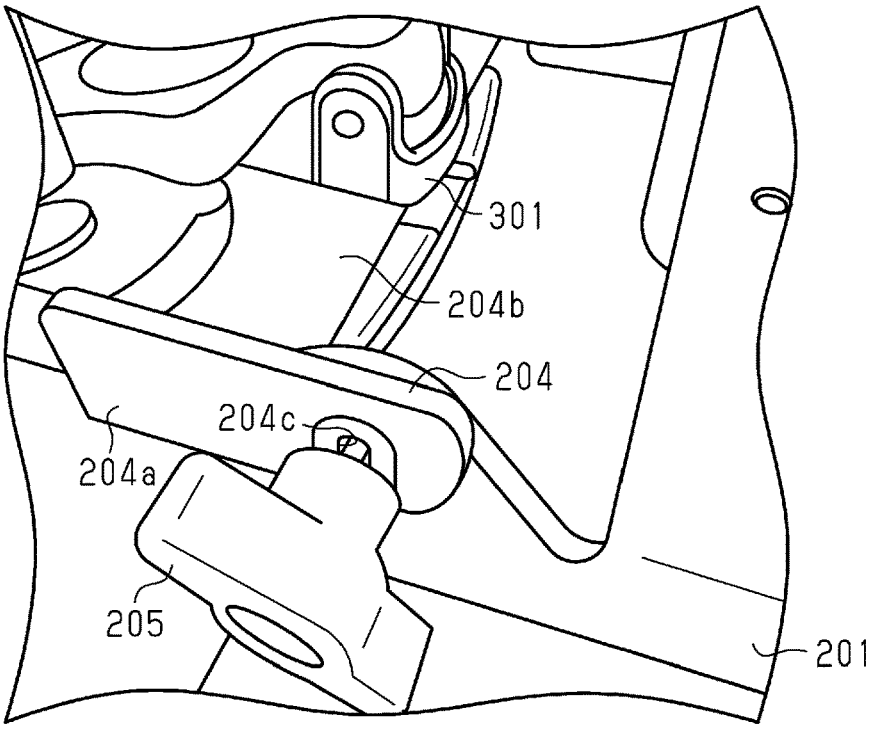
FIG. 19 is a partially enlarged perspective view showing a coupling portion of the bass pad and a pedal device.

Instead of the positioning member 60 shown in FIG. 10, a positioning member 80 shown in FIG. 17 may be used. As shown in FIG. 17, instead of the first positioning portion 63 of the positioning member 60, the positioning member 80 includes a fastening portion 81 that is fastened to the main post 22 of the bass pad 10. Further, instead of the second positioning portion 64 of the positioning member 60, the positioning member 80 includes a clamp portion 82 that fixes the pipe of the tom stand 11S. When the fastening portion 81 is fastened to the main post 22 by two screws 83, the positioning member 80 is attached to the bass pad 10. The positioning member 80 is also attached to the tom stand 11S by fixing the clamp portion 82 to the pipe of the tom stand 11S with a bolt 84 and a wingnut 85. In this manner, the positioning member 80 positions the tom stand 11S relative to the bass pad 10 and prevents displacement of the tom stand 11S relative to the bass pad 10. Moreover, this structure allows the tom stand 11S to be positioned relative to the bass pad 10 regardless of whether the tom stand 11S includes a leg.

The positioning members 60 and 80 may be used to position the snare stand 12S, the cymbal stand 13S, and the hi-hat stand 14S relative to the bass pad 10 in addition to positioning the tom stand 11S relative to the bass pad 10.

The positioning member 60 is formed by the positioning body 61 and the damper 62. However, the damper 62 may be omitted, and the positioning member 60 may include only the positioning body 61.

The coupling position of the pad body 30 on the main post 22 is changed in a stepped manner between the first position and the second position but may be changed in a stepless manner instead. For example, instead of the upper holes 23 and the lower holes 24 formed in the main post 22, elongated holes may be formed in the axial direction of the main post 22 so that the coupling position of the pad body 30 is changeable in a stepless manner along the elongated holes in the axial direction of the main post 22.

The position of the distal ends of the legs 41 does not have to be adjusted in accordance with the open amount of the legs 41 from the main post 22. The legs 41 may be movable relative to the main post 22 so that the position of the distal ends of the legs 41 is adjusted by moving the legs 41 in the axial direction of the main post 22. Alternatively, the legs 41 may be extendable and retractable so that the position of the distal ends of the legs 41 is adjusted by changing the length of the legs 41.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A bass drum pad used in a state coupled to a clamp of a pedal device, the bass drum pad comprising:

a pad base fixed to the clamp;

a main post arranged integrally with the pad base;

a pad body arranged on the main post and beaten by the pedal device; and a leg arranged on the main post or the pad body and used when setting the bass drum pad, wherein the bass drum pad is configured so that a height and an angle of the pad base are adjustable, the height of the pad base is taken along an orthogonal line that is orthogonal to a setting surface on which the bass drum pad is set, and the angle of the pad base is an angle of an axis of the main post relative to the orthogonal line.

2. The bass drum pad according to claim 1, wherein the bass drum pad is configured to allow for adjustment of the height and the angle of the pad base in a state in which the pad base is separated from the setting surface.

3. The bass drum pad according to claim 2, wherein the bass drum pad is configured to allow for adjustment of a position of a distal end of the leg in a state in which the bass drum pad is coupled to the clamp.

4. The bass drum pad according to claim 1, wherein the leg is attached to the main post in a manner allowing the leg to open and close with respect to the main post, and the height and the angle of the pad base are adjustable in accordance with an open amount of the leg from the main post.

5. The bass drum pad according to claim 4, further comprising:

a stay attached to the main post in a manner allowing the stay to open and close with respect to the main post; and a sliding member attached to the main post in a slidable manner and coupled to the leg or the stay, wherein the leg and the stay are each configured to be opened and closed with respect to the main post when the sliding member is moved in an axial direction of the main post and held in an open state or closed state with respect to the main post by fixing the sliding member to the main post.

6. The bass drum pad according to claim 5, wherein the leg and the stay are each configured to be fully open with respect to the main post when the sliding member is located at an upper limit position on the main post and closed with respect to the main post when the sliding member is located at a lower limit position on the main post, and the upper limit position and the lower limit position respectively correspond to an upper limit and a lower limit of a range in which the sliding member is movable on the main post.

7. The bass drum pad according to claim 6, wherein the leg and the stay are configured to be arrangeable at positions overlapped with the main post when the sliding member is located at the lower limit position.

8. The bass drum pad according to claim 1, wherein the leg includes two legs.

9. The bass drum pad according to claim 1, wherein the bass drum pad is configured to change a coupling position of the pad body on the main body, and the coupling position of the pad body is a position on the main post in an axial direction of the main post.

10. A drum kit, comprising:

a bass drum pad beaten by a pedal device;

a percussion instrument pad that differs from the bass drum pad;

a stand to which the percussion instrument pad is attached, wherein the bass drum pad is located between the stand and the pedal device; and a positioning member used to position the stand relative to the bass drum pad, wherein the positioning member is configured to allow the stand to be positioned relative to the bass drum pad when arranged in contact with the bass drum pad and the stand, and the positioning member includes a first fitting portion partially fitted to the bass drum pad, and a second fitting portion partially fitted to the stand.

11. The drum kit according to claim 10, wherein the positioning member further includes a damper.

12. The drum kit according to claim 10, wherein the positioning member includes a fastening portion fastened to the bass drum pad, and a clamp portion fixed to the stand.

* * * * *